US005466205A

United States Patent [19]

McLane et al.

[11] Patent Number: 5,466,205

[45] Date of Patent: Nov. 14, 1995

[54] TRACTION DEVICE WITH A SELF CLAMPING RETAINER

[76] Inventors: Michael J. McLane; Maxine L. Duckworth, both of 17434 Rancho de La Angel, Ramona, Calif. 92065

[21] Appl. No.: 291,363

[22] Filed: Aug. 16, 1994

Related U.S. Application Data

[63] Continuation-in-part of Ser. No. 147,291, Jun. 14, 1993, abandoned.

[51] Int. Cl.[6] ..... A63B 26/00

[52] U.S. Cl. ..... 482/140; 482/145; 606/242

[58] Field of Search ..... 482/140, 142, 482/145; 108/131, 35, 36; 606/241, 242

[56] References Cited

U.S. PATENT DOCUMENTS

| | | | |
|---|---|---|---|
| 2,871,076 | 1/1959 | Mell | 108/36 |
| 3,368,504 | 2/1968 | Cohen | 108/36 |
| 3,664,666 | 5/1972 | Lloyd | 482/145 |
| 4,136,868 | 1/1979 | Hogue | 482/145 |
| 4,333,638 | 6/1982 | Gillotti | 108/36 |
| 4,383,684 | 5/1983 | Schliep | 482/145 |
| 4,609,192 | 9/1986 | Bratcher | 482/145 |
| 4,887,536 | 12/1989 | Teichner | 108/35 |
| 4,927,128 | 5/1990 | O'Brian | 108/36 |

*Primary Examiner*—Lynne A. Reichard

*Attorney, Agent, or Firm*—John J. Murphey; Murphey Law Offices

[57] ABSTRACT

A traction device including, in combination, an elongated flat surface of a length and width to accommodate a human patient in a supine position, the surface defined by a foot-end and a head-end arranged in a spaced-apart relationship, device for elevating the foot-end above the head-end in a tilted fashion, and a foot retainer pivotally attached about the foot-end for retaining the patient's feet therein when the patient is in traction, wherein the elongated flat surface exhibits an extremely low coefficient of friction for allowing the patient's body to stretch and slide freely downward therealong under its own weight when pitched in a head-down position.

23 Claims, 3 Drawing Sheets

TRACTION DEVICE WITH A SELF CLAMPING RETAINER

RELATION TO OTHER PATENT APPLICATIONS

This is a Continuation-in-Part of my previously filed application titled "Folding Slantboard With Self Energizing Foot Restraint", filed Jun. 14, 1993, and assigned Ser. No. 08/147291 now abandoned.

BACKGROUND OF THE INVENTION

1. Field of the Invention

This invention pertains to the field of traction devices. More particularly it pertains to devices for therapeutical use by medical professionals and individuals alike to relieve and treat back and neck pain. The device employs a surface skinned with a material having an extremely low coefficient of friction. By elevating the feet above the head, the patient's body tends to slide downward stretching the body and the spine thereby applying traction forces along the spine and neck portions of the patient.

2. Description of the Prior Art

Human beings evolved over millions of years from a primate species into an ingenious biological wonder. Humans live longer and enjoy a standard of life beyond and atop of any other biological creature on this planet. The standard of life is largely accounted by the human's ability to reason, make decisions and employ inanimate and biological tools to aid him or her in achieving a specific goal. However, the human body has evolved at a slower pace. As science and generations of achievement has steadily advanced the term of the average human life span, the human bodies have not evolved at the same pace.

Thus, the human bodies tend to break down at a relatively early age by today's standards. Individuals often begin to feel and suffer from back and neck discomfort and/or pain at the age of thirty years and on. As the age curve progresses, more and more of the population finds itself in the masses of people suffering from chronic or occasional back and neck pain and discomfort.

To alleviate the pain, the chiropractic and medical arts have used massage, exercise, drugs, heating, traction treatments and, as a last resort, an intrusive procedure such as surgery.

Various patents and the prior art have attempted to create a simple, easily transportable, light weight, and economical traction device, suitable for professional and home use. However, each device and method in the prior art includes associated problems.

U.S. Pat. No. 4,444,178 discloses a device consisting of an inverted board wherein the weight of the patient provides the traction to the back and neck areas. However, the device does not teach or disclose the surface accommodating the patient to be skinned by an extremely low coefficient of friction material. Further, the device calls for a pair of ankle support pads to retain the patient's body. The device does not disclose a hinged foot retainer having self-clamping attributes of the present invention, wherein the foot retainer grip is directly proportionate with the body weight of the patient.

U.S. Pat. No. 4,136,868 discloses an exercising board having a pair of height adjustable legs at the foot-end of the board and a head-end resting on the ground plane supporting the device. However, the device does not teach or disclose the surface accommodating the user to be skinned by an extremely low frictional material. In the field of exercising equipment, a high friction coefficient material is more desirable to aid in retaining the person's position thereon. The device of this invention teaches away from that prior art. The high coefficient of friction is desirable in the field of exercise equipment, as the user must have a high degree of control when exercising, otherwise injuries are likely to result leading to the need of a traction device. Further, the device calls for a strap across the board span to retain the patient's body. The device does not disclose a hinged foot retainer having self-clamping attributes of the present invention, wherein the foot retainer grip is directly proportionate with the body weight of the patient. Therefore, the disclosed strap is usable and sufficient for a brief time the user is exercising, but not usable in an environment of a relatively prolonged traction therapy.

U.S. Pat. No. 4,512,572 discloses an exercise stand having pivotal engagement with a vertical member along one of its terminal edges, allowing the user to define an incline of the surface area used for situps or exercises alike. Further, the device discloses a pair of foot holsters snugly clamping about the user's ankles, thereby securing the user in a head inverted position during exercise activities. The board tilt stems from a flat horizontal body arrangement to a 90° head-down arrangement. However, the device does not teach or disclose a surface to be skinned by an extremely low frictional material. In the field of exercising equipment, a high coefficient of friction is likely to be more desirable, thus, the device teaches away from the present invention. The high coefficient of friction is desirable in the field of exercise equipment, as the user must have a high degree of control when exercising, otherwise injuries are likely to result leading to the need of a traction device. The device does not disclose a hinged foot retainer having self-clamping attributes of the present invention, wherein the foot retainer grip is directly proportionate with the body weight of the patient. The foot retainer of the present invention is not useable in the device and the device foot retainer would not accommodate the needs of a patient in the present invention. The foot retainer of the device would be uncomfortable in the relatively prolonged use associated with traction therapy. Further, the device foot retainers would limit the blood circulation about the lower leg portions of the user over a prolonged duration of use characteristic to the traction therapy. The foot retainer of the present invention would not be suitable for use with the device, as it does not provide sufficient security to a user positioned in a 90°, head-down relationship to the ground plane.

The U.S. Pat. No. 210,083 illustrates a tilted exercise board having two support members coupled together for stability. Further, the board illustrates a strip which may be suitable for employment as a foot retainer. However, the device does not illustrate a self retaining foot bracket, a padded area about the feet of the user and a skin material having a low coefficient of friction. As described above, exercise equipment in general requires a high coefficient of friction for control by the user of his or her body during the exercise to minimize the risk of injury and to maximize the results of the exercise activity.

U.S. Pat. No. 2,658,754 discloses a foldable resting and exercise table suited for a user to lie in a head-down position. The device employs two stands for elevating the foot-end of the table above the head-end in a tilted fashion and provides for a foot strap to retain the user in position. However, the device does not disclose a self retaining foot bracket, a padded area about the feet of the user and a skin material having a low coefficient of friction. As described above, exercise equipment in general requires a high coefficient of friction for control by the user of his or her body during the exercise to minimize the risk of injury and to maximize the results of the exercise activity.

The U.S. Pat. No. 4,531,731 discloses a gymnastics board which is present to a tilted position and is displaced from the floor plane in an isosceles arrangement of two support members. The tilt is manually preset by the user for a specific exercise and in the event the user wishes to be in a head-down position, he or she may strap their ankles in an ankle securing tube. However, the device does not disclose a self-retaining foot bracket, a padded area about the feet of the user and a skin material having a low coefficient of friction. As described above, exercise equipment in general requires a high frictional material for control by the user of his or her body during the exercise to minimize the risk of injury and to maximize the results of the exercise activity.

The U.S. Pat. No. 4,531,731 discloses a gymnastics board which is present to a tilted position and is displaced from the floor plane in an isosceles arrangement of two support members. The tilt is manually preset by the user for a specific exercise and in the event the user wishes to be in a head-down position, he or she may strap their ankles in an ankle securing tube. However, the device does not disclose a self retaining foot bracket, a padded area about the feet of the user and a skin material having a low coefficient of friction. As described above, exercise equipment in general requires a high coefficient of friction for control by the user of his or her body during the exercise to minimize the risk of injury and to maximize the results of the exercise activity.

U.S. Pat. No. 4,913,424 discloses a slant board having a variable tilt position controlled by the user through a remote control. The board is pivotally hinged on a base and is tilted by a hydraulic push arm which corresponds to the remote commands issued by the user. Further the device discloses a foot retainer which comprises a padding about a transverse member attached to the board through a perpendicular shank. However the disclosed foot retainer is fixed onto the board and does not exhibit self clamping attributes found in the present invention. The device does not disclose a self-retaining foot bracket, a padded area about the feet of the user and a skin material having a low coefficient of friction. Further, there is no teaching of use of a material skinning the board having a low coefficient of friction. As described above, exercise equipment in general requires a high coefficient of friction for control by the user of his or her body during the exercise to minimize the risk of injury and to maximize the results of the exercise activity.

SUMMARY OF THE INVENTION

This invention pertains to the traction treatments and provides for a novel traction device which allows a patient to suspend his or her body in a head-down, tilted fashion, on a the surface skinned with a very low frictional material and his or her feet retained by a comfortable self-clamping retainer generously padded about the ankle and foot area for comfort and added traction. The invention is a traction board for therapeutic relief from body aches, neck pain and back pain. The invention employs a surface of sufficient length, width and strength to support a human patient in a flat supine position. The surface is skinned with a material having a low coefficient of friction and is tilted for a head-down, supine patient position. The mass of the patient's body stretches the muscles and bone junctures of the patient by the gravitational force applied to and by the patient's body. To retain the person in a tilted, head-down position, the surface incorporates a foot retainer pivotally hinged at the foot-end of surface.

The foot retainer is constructed of a transverse bar and a perpendicular shaft wherein the shaft is attached between one end of the bar and the side of the foot-end of surface. Additionally, the transverse bar and/or the shaft perpendicular thereto are wrapped in a thick pad for the comfort of the patient's ankles. Another reason for applying a generous pad about the retainer is to allow the patient's feet to sink toward the bar and thereby create a greater amount of material surface area to comfortably retain the ankles during a prolonged treatment. The foot retainer is hinged to the foot-end of the traction board surface, the ankles of the patient guide the foot retainer to clamp down about the ankle and the foot area of the patient. The clamping force of the foot retainer is thus governed by the force exerted by the patient's feet, and body; the feet are directly proportional to the weight of the patient. Therefore, the clamping force is variable and proportionate to the body weight of an individual patient, allowing a universal retainment means which is comfortable to each and every patient and allows for a prolonged therapeutic traction session free of discomfort associated with known retainment means such as straps and alike which tend to cut off the blood supply to the feet.

The surface is supported in a pitched position by a pair of U-shaped support members. The support members are attached to the surface about its sides. A first pair of stop stubs is attached adjacent to the first support member to secure the support member's perpendicular position in respect to the ground plane. A second pair of stop stubs is attached adjacent to the second support member to secure the member's perpendicular position in respect to the ground plane. The stubs are attached in between the first and second members thereby functioning as a stop for the members inward collapse. To prevent the members' outward collapse, a cable or a series of cables span between and are attached to each support member.

To accommodate transport of the device, the surface is divided into a top and a bottom section which are hingedly attached about their respective marginal edges. The sections fold toward each other mutually meeting along the back side of the surface and are locked in position by means such as VELCRO®.

Accordingly, the main object of this invention is a traction device comprising of a low coefficient of friction, a surface having spaced-apart head and foot-ends wherein the foot-end is elevated above the head-end in a tilted arrangement. It is a further object of this invention to employ the body weight of the patient in combination with the gravitational forces exerted on the body and the low friction surface, to provide the patient a comfortable, therapeutic traction session. A further object of this invention is to provide a self-clamping foot retainer padded about a transverse bar meeting the patient's ankle and foot area. Another object of this invention is to provide for greater surface area between the foot retainer and the ankle area by a thick pad about the foot retainer and allowing the patient's feet to sink into the pad. It is an object of this invention to allow for a comfortable suspension in a head-down position, free of blood circulation breaches. It is a further object of this invention to provide for a generously padded area about the heel portion of the patient's feet to promote comfort and longevity of a traction session.

The result in the use of this invention is a versatile, light weight, inexpensive traction device which is foldable and transportable from place to place and conducive to use in an institutional as well as home environment. Even further, use of this invention promotes an affordable means for relaxation and relief from body, back and neck pain.

These and other objects of the invention may be determined by reading the following description of the preferred embodiment taken together with the drawings appended hereto. The scope of protection sought by the inventors may be gleaned from a close reading of the claims that conclude this specification.

DESCRIPTION OF THE PREFERRED EMBODIMENT

Figure 3:
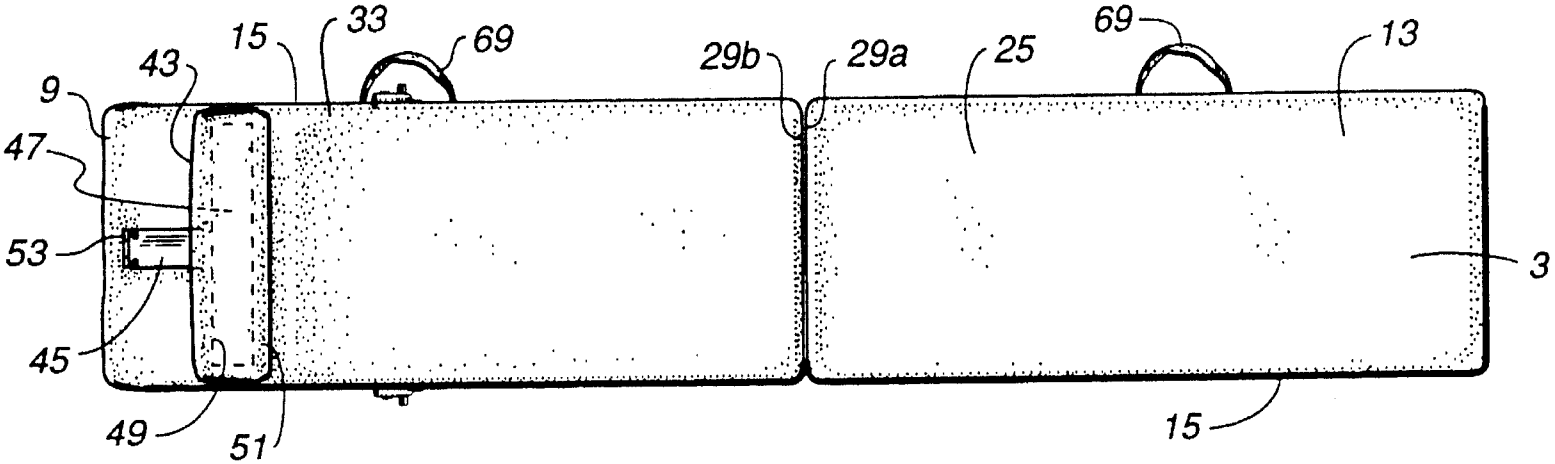
FIG. 3 is a top plan view of the preferred embodiment.
Figure 1:
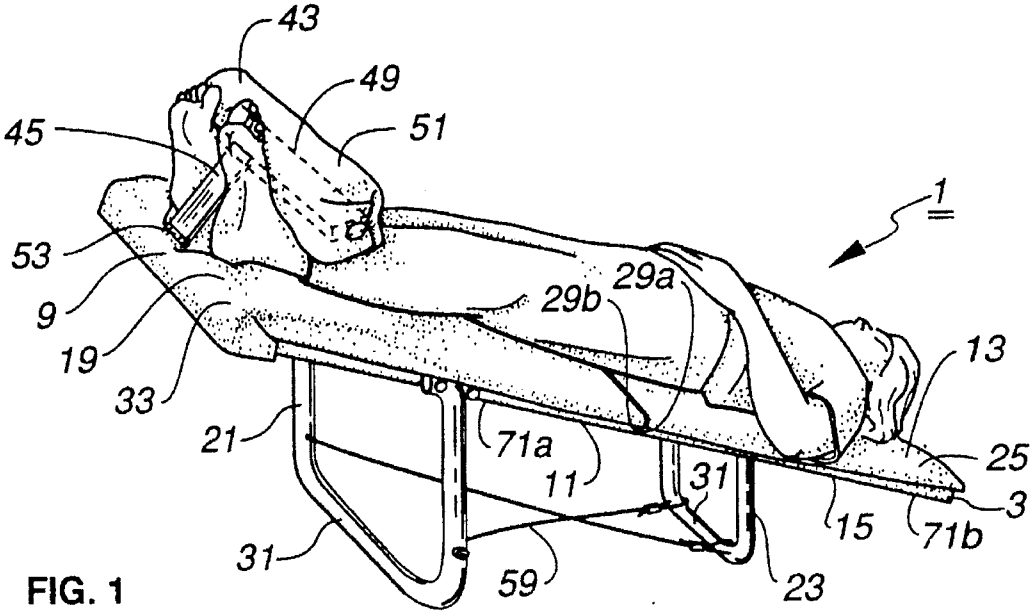
FIG. 1 is an illustrative view of the preferred embodiment showing a patient in a tilted, head-down position.

Referring to the drawings wherein like numerals identify like elements throughout the eight drawings, the invention is shown to comprise an elongated rectangular traction device 1, shown in FIG. 1. Traction device 1 consists of a flat surface 3 defined by spaced-apart foot-end 9 and head-end 13, joined about their two marginal ends by spaced-apart sides 15. As formed, surface 3 is rigid flat and rectangular, having sufficient width, length, height and strength to accommodate a human patient in a supine generally elevated position. In the preferred embodiment surface 3 is made of plywood; however, surface 3 may also be constructed of composites, plastics and/or metals such as steel or aluminum. Although the preferred embodiment teaches a rectangular configuration of surface 3, other embodiments may include circular, oval or any other geometrical or random definition.

Surface 3 includes a frame 11 constructed of hollow, solid, or rigid tubing such as aluminum tubing. In the preferred embodiment, frame 11 comprises hollow, aluminum tubing having a square and/or rectangular crossection spanning along the marginal edges of surface 3.

Figure 2:
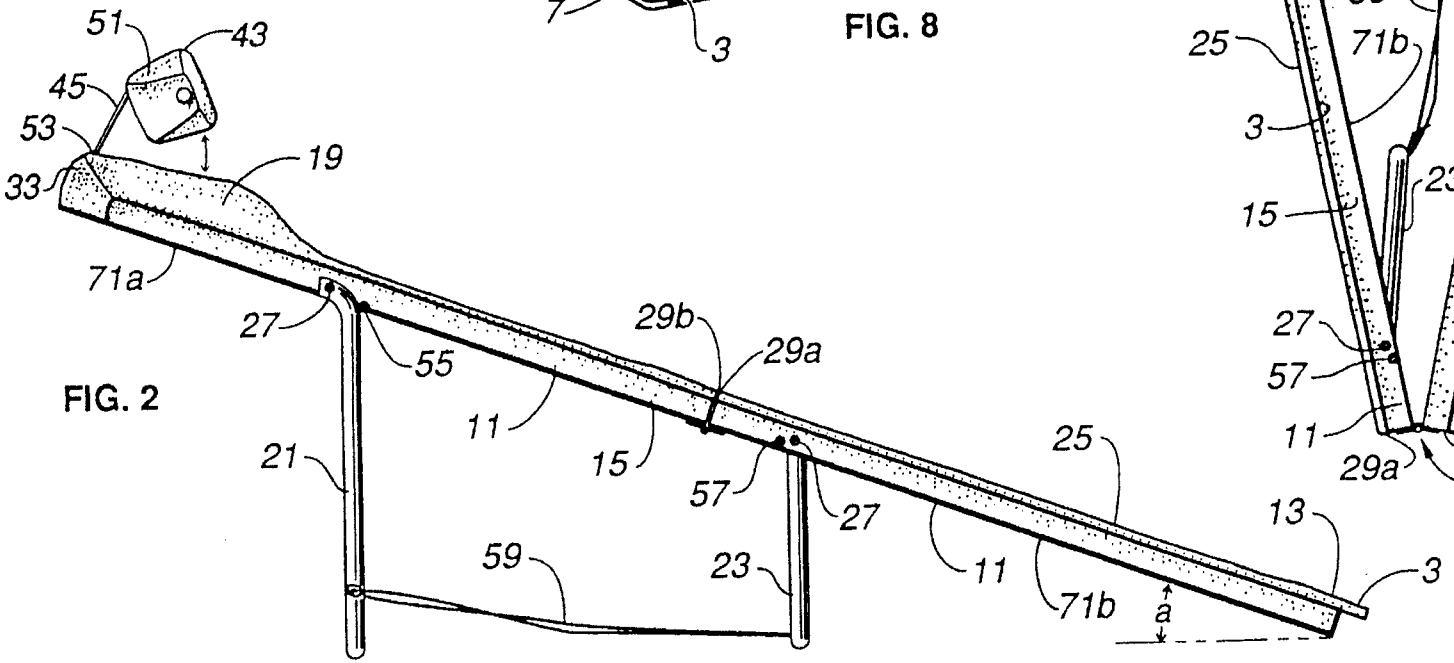
FIG. 2 is a side plan view of the preferred embodiment.

In the preferred embodiment, surface 3 supports the patient in a pitched, and/or tilted head-down position. To achieve a preferred pitch and/or tilt of approximately 20° foot-end 9 is arranged above head-end 13. To support the patient in such a pitched and/or tilted position, any means known in the art may be employed. The preferred embodiment of the present invention employs two U-shaped stands or support members 21 and 23, respectively, illustrated in FIGS. 1 and 2.

In one embodiment, first U-shaped stand 21 is employed to elevate the surface by abutting the floor at one end and supporting the surface at the other end. U-shaped stand 21 is arranged in a 90° relationship to the floor and approximately a 20° and/or 160° relationship to surface 3. In the preferred embodiment, U-shaped stand 21 is attached to frame 11 closer to foot end 9. Foot-end 9 of surface 3 rests on the ground plane supporting device 1.

It is conceivable to support surface 3 in a variety of angles using a variety of means. The preferred embodiment employs two U-shaped stands 21 and 23, respectively. U-shaped stands 21 and 23 have two terminal ends and a straight mid portion 31 which is used to meet the ground or support plane for device 1. First U-shaped stand 21 is attached to frame 11 between the middle of surface 3 and foot-end 9. Second U-shaped stand 23 is attached to frame 11 between the middle of surface 3 and head-end 13. To achieve the tilted, head-down patient position, first U-shaped stand 21 is made taller than second U-shaped stand 23. Both U-shaped stands 21 and 23 are arranged in a 90° relationship to the ground plane and in a preferably 20° and/or 160° relationship to surface 3 thereby supplying the preferred pitch of 20° for the patient. The length of U-shaped stands 21 and 23 members is trimmed and adjusted according to the stands attachment location at frame 11.

Figure 4:
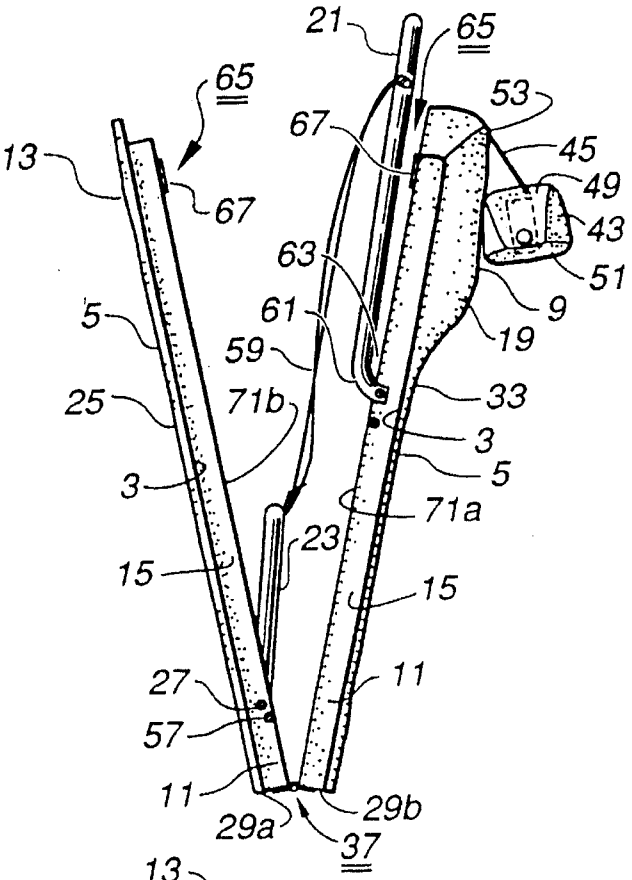
FIG. 4 is a side plan view of the preferred embodiment in a partially folded position.
Figure 5:
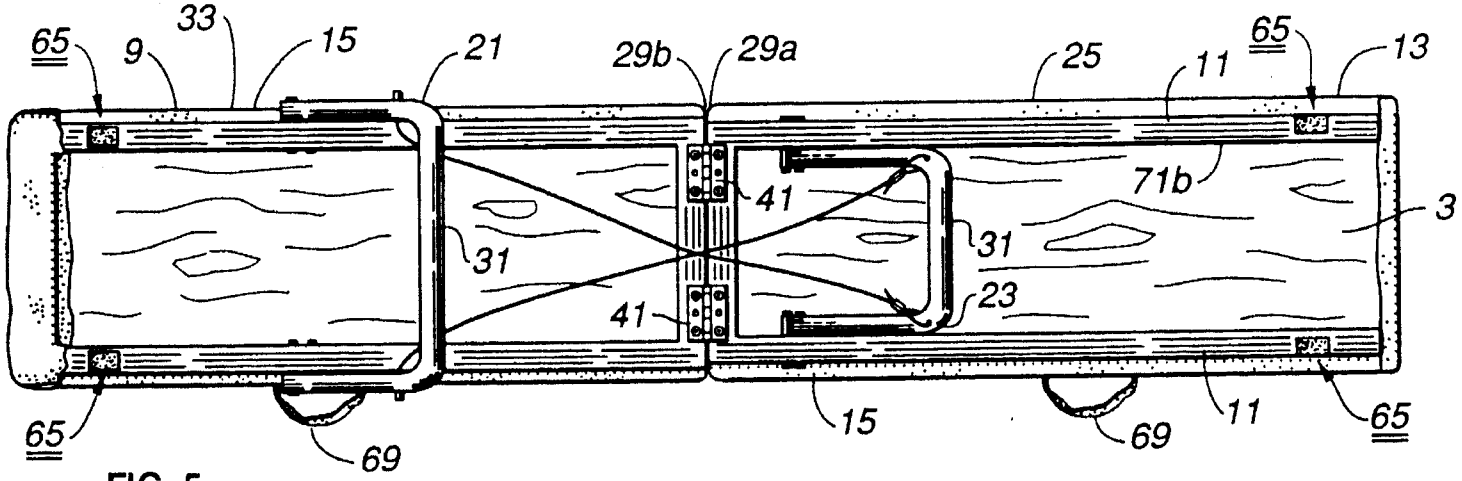
FIG. 5 is a bottom plan view of the preferred embodiment.

In the preferred embodiment, surface 3 is transportable from place to place allowing versatility and use of the device both in an institutional and personal environment. In the transportable environment, it is desirable to create.traction device 1 which is foldable for ease of loading, unloading and transporting as illustraton in FIG. 4. Further, it is desirable to have a lightweight device having handles 69 for ease of carrying the same. To limit the weight of device 1, the preferred embodiment employs aluminum tubing for frame 11 and a plywood surface 3. Further, the preferred embodiment allows for surface 3 to fold about the mid section of device 1 thereby defining a top section 33 and a bottom section 25 as shown in FIG. 4. Top and bottom sections 25 and 33 share adjacent marginal edges **29*a* and 29*b* at the middle section of surface 3. The marginal edges 29*a* and 29*b* are joined in place by a piano or door hinge 41 as shown in FIG. 5. Although set-apart door hinges 41 are preferred for the economy and availability thereof, other hinge means 37 are also useable. For example, a piano hinge may be employed to join marginal edges 29*a* and 29*b* of top and bottom sections 25 and 33** respectively.

In the preferred embodiment, hinges 41 are fastened or screwed onto the frame undersides 71a and 7lb. Because frame 11 of the preferred embodiment has a square crossection, frame 11 and associated the surface sections 25 and 33 pivotally rotate toward each other at the mutual hinge edges **29*a* and 29*b*, allowing head-end 13 and foot-end 9 to arc toward each other to a transport position as shown in FIG. 4. The transport position consists of bottom section 25 and top section 33 juxtaposedly and mutually abutting each other along frame undersides 71*a* and 71*b*. In the preferred embodiment, frame 11 is constructed of square, hollow tubing thereby allowing an organized, mutual meeting of frame sections 11 when sections 25 and 33** are folded in a transport position.

Another reason for employing square metal tubing for construction of frame 11 is to prevent the inward collapse of sections 25 and 33 under their own weight and/or the weight of the patient. Upon exertion of the force vector supplied by the patient's weight along respective hinge-edges **29*a* and 29*b*, the underside edges of frame 11 are anchored in place to support the weight of the patient by hinge means 37. As the patients body exerts a force vector directed toward the source of gravity, adjacent hinge-ends 29*a* and 29*b* tend to separate and are held and/or anchored in place by hinge means 37. In the preferred embodiment hinge means 37 consists of two axially set-apart door hinges 41. A combination of two set-apart door hinges 41 are preferred over other available hinge means 37 as door hinges 41 provide superior transverse stability to device 1 at hinge edges 29***a* and 29*b*. Further, two door hinges 41 are more economical to install and to procure than one continuous piano hinge. In another embodiment, a continuous piano hinge may replace the two door hinges.

To provide for the transport position of the two sections 25 and 33, wherein they are folded in a mutual juxtaposed position along frame undersides 71*a* and 71*b*, U-shaped stands 21 and 23 must fold with device 1, must be placed out of the way and not impede the unobstructed edge of the underside of frame 11 sections, thereby allowing frame undersides 71*a* and 71*b* to juxtaposedly meet for transport. To meet this requirement, the diameter of U-shaped stands 21 and 23 crossections must be equal to or less then the crossection of frame 11.

In the preferred embodiment, second U-shaped stand 23 is pivotally mounted on the inside sides of frame 11. U-shaped stand 23 is constructed of a hollow rigid material suitable to support the weight of the human patient. In the preferred embodiment, U-shaped stand 23 is constructed of hollow aluminum tubing thereby providing the requisite strength for support of the patient, along with a low weight for allowing ease of transport and economy of manufacture. More particularly, U-shaped stand 23 includes a "U" configuration wherein mid-portion 31 is substantially straight for meeting the floor support and for providing stability to device 1. U-shaped stand 23 further includes two arms which are integral to the mid-portion and are in a 90° relationship thereto. The arms are generally of equal length to provide vertical support to surface 3. The terminal ends of the arms and U-shaped stand 23 are pivotally joined by a peg-hole arrangement 27, shown in FIG. 7, wherein U-shaped stand 23 is free to pivot 180° about its pivotal origin, limited from a 360° span by surface 3 which obstructs its pivotal span.

First U-shaped stand 21 shares all the characteristics of second U-shaped stand 23. First U-shaped stand 21 is pivotally mounted along its terminal ends by peg-hole arrangement 27 to the outside sections of frame 11 of top section 33. The pivotal mounting provides for a 180° movement of U-shaped stand 21, the movement is limited to 180° by surface 3. This allows first U-shaped stand 21 to fold outside frame 11 during transport and thereby not obstruct the folded, juxtaposed arrangement of frame 11 during transport. In order for first U-shaped stand 21 to fit within the cavity created by juxtaposed frame 11 sections, the diameter of the U-shaped stand crossection must be equal to or less then the crossection of frame 11.

The proportionate length of U-shaped stands arms 21 and 23, respectively, in combination with the placement of U-shaped stands 21 and 23, along frame 11 determines the pitch and/or tilt of device 1. In the preferred embodiment, the length of first U-shaped stand 23 is greater than the distance from its hinged position to foot-end 9 of top section 33. This configuration allows U-shaped stand 21 to fold along the outside edge of frame 11 and allows mid-portion 31, straight, horizontal portion of U-shaped stand 21, to clear or extend slightly beyond the terminal ends of frame 11 for allowing top and bottom sections 33 and 25, respectively, to juxtaposedly meet along its frame 11 sections for transport. In addition, because the first U-shaped stand 21 is mounted outside frame 11, it allows unobstructed juxtaposed meeting of frame 11 sections.

To accommodate transport of device 1 a lock means 65 is provided to retain top and bottom sections 25 and 33 mutually attached. In the preferred embodiment VELCRO® strips 67 are provided along frame 11. In another embodiment a hook and loop arrangement may be employed.

Figure 6:
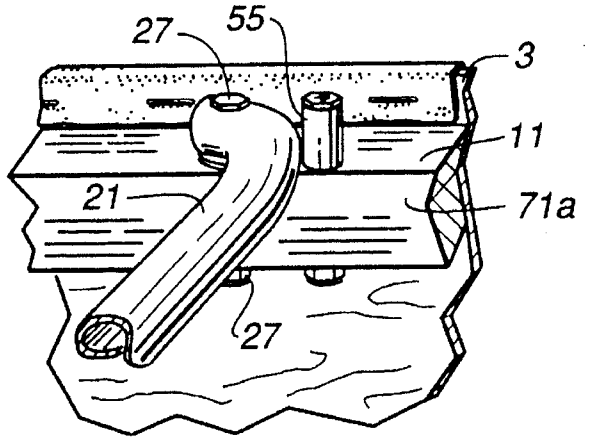
FIG. 6 is a partially cut-away perspective view of the first U-shaped stand junction with the surface and the corresponding stops.

In the preferred embodiment, the first U-shaped stand 23 terminal ends are curved as shown in FIGS. 4 and 6. The curve is of sufficient radius to accommodate the size of a human hand. This arrangement is desirable for safety considerations. As the patient mounts surface 3, he or she is likely to place his or her hands at or about the point of pivotal attachment of first U-shaped stand 21 and frame 11. In the unlikely event of U-shaped stand 23 collapse, surface 3 and the patient thereon collapse thereby trapping or severing the patient's fingers and/or wrists between U-shaped stand 23 and frame 11 in a scissor arrangement. This potential disaster is avoided by first U-shaped stand 21 employing curved terminal ends 61. Terminal ends 61 provide for a space pocket 63, shown in FIG. 4, of sufficient diameter to accommodate a human hand therein. Therefore, in the event of the collapse, the patient's hands would not be severed by the scissored arrangement of frame 11 and first U-shaped stand 21.

In the preferred embodiment, U-shaped stands 21 and 23, respectively, support surface 3 in a head-down, pitched and/or tilted position. U-shaped stands 21 and 23, respectively, stand in a 90° relationship to the supporting floor plane. Because U-shaped stands 21 and 23 are pivotally attached to frame 11, an anchoring mechanism is required to prevent the collapse of U-shaped stands 21 and 23.

To prevent U-shaped stands 21 and 23 from collapsing in the outward direction towards their respective head-end 13 and foot-end 9, the preferred embodiment employs a flexible, non-resilient cable 59 attached to and spanning between mid-portion 31 of U-shaped stands 21 and 23. Cable 59 is of a length allowing U-shaped stands 21 and 23 to stand in a 90° relationship to the supporting floor plane. In the preferred embodiment two cables 59 are employed in a criss-cross arrangement.

Figure 7:
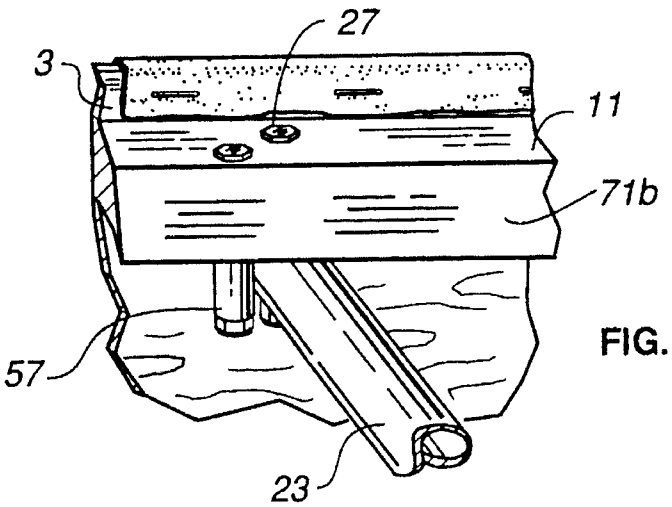
FIG. 7 is a partially cut away perspective view of the second U-shaped stand junction with the surface and the corresponding stops; and, FIG. 8 is a partially cut away, sectional view of the surface and the surface pad.

To prevent U-shaped stands 21 and 23 from an inward collapse toward their respective hinge edges 29*a* and 29*b*, a first and second pair of stop stubs 55 and 57, as shown in FIGS. 6 and 7 are positioned along frame 11 to prevent the free fall of surface 3.

More particularly, the first pair of stop stubs is placed at a distance below the peg-hole pivot 27, for first U-shaped stand 21 and toward hinge-end 29*a*. The distance is governed by the diameter of first U-shaped stand 21 crossection. The distance must be slightly greater then the diameter of U-shaped stand 21. This arrangement allows U-shaped stand 21 to travel into the transport position upon folding of top and bottom sections 25 and 33 respectively. More importantly, stop stubs 55 prevent U-shaped stand 21 from collapsing inward toward its respective hinge-end 29*a* while device 1 is in use.

A similar arrangement and advantage coexists between second U-shaped stand 23 and second pair of stop stubs 57. Stop stubs 19 are placed at a distance below peg-hole pivot 27 for second U-shaped stand 23 and toward hinge-end 29*b*. The distance is governed by the diameter of U-shaped stand 23 crossection. The distance must be slightly greater then the diameter of U-shaped stand 23. This arrangement allows U-shaped stand 23 to travel into the transport position upon folding of the top and bottom sections 25 and 33 respectively. More importantly, stop stubs 57 prevent U-shaped stand 23 from collapsing inward toward its respective hinge-end 29*b* while device 1 is in use.

In sum, first and second U-shaped stands 21 and 23, respectively, enjoy a master-slave relationship. In the unfolded position of device 1 U-shaped stands 21 and 23 will not collapse inward because they are held in perpendicular position to the floor by stop stubs 55 and 57. Further, U-shaped stands 21 and 23 will not collapse outward because U-shaped stands 21 and 23 relative position to each other is governed by cable 59 attached to U-shaped stands mid-portion.

To retain the patient in a head-down position, device 1 employs a foot retainer 43. The patient is positioned in a head-down, pitched and/or tilted position following and sliding along the slope and the pitch of surface 3, as defined by the length and position of U-shaped stands 21 and 23. To prevent the patient from sliding down the pitch of surface 3, patient is held about his or her feet by foot retainer 43.

Foot retainer 43 employs a T-bracket 47 consisting of a bracket base 45 and a transverse, integral top 49. Base 45 is axially hinged by a hinge 53 to foot-end 9 of surface 3. The preferred embodiment employs a door hinge 53 for economy of manufacture and ease of use. Transverse top 49 is centrally attached to base 45 and is heavily padded by a pad 51 such as polyurethane or the like. Pad 51 serves a dual purpose. First, it is necessary and favorable for a prolonged traction therapy, providing comfort to the patient. Pad 51 additionally prevents circulation from being interrupted and/or being cutoff to the limbs of the patient.

The second purpose for pad 51 is to increase the surface area of the patient's skin in contact therewith. The increased skin to material contact is desirable along foot retainer 43 to distribute the pressure about the foot and ankle area associated with the support of the patient.

Additionally, surface 3 includes a generously padded area 19 for the patient's feet and heels. Padded area 19 is located within the arc circumference or diameter of foot retainer 43 pivoting about axial hinge 53 as defined by the length of base 45. As with pad 51, the padded area 19 serves a dual purpose. First, it promotes comfort to the patient and patient's feet and heels which are involved in a prolonged therapeutical traction session. By employing a generously padded area 19, the patient's feet and or limbs do not suffer from a cutoff of circulation or what is commonly known as "falling asleep". Secondly, padding area 19 provides for greater skin to material 5 the surface area for increasing the traction necessary to maintain the patient in a steady head-down, pitched and/or tilted position.

Foot retainer 43 and its axial hinge 53 provide for a novel self-retaining means to keep the patient on surface 3 free of tie downs and/or uncomfortable retaining means. Foot retainer 43 comprises base 45 and top 49 transversely attached thereto, wherein base 45 is pivotally attached to foot-end 9 and the patient's feet are placeable between top 49 and a terminal end of pivotally attached base 45 for automatically and self adjustingly clamping the ankles of the patient as top 49 is pivotally pulled by the patient's feet to surface 3 and atop the patient's ankles by the gravitational force exerted on the patient's body. As the patient places the top of his feet behind pad 51, surroundingly attached to bracket top 49, and suspends his weight atop of pitched and/or tilted surface 3, the feet of the patient pull bracket top 49 and its base 45 toward the patient's head in a downward direction. The force of the patient's weight, as it slides along surface 3, pulls hinged retainer 43, which in turn clamps about the patient's ankle area, as retainer 43 base 45 rotates at hinge 53. Retainer 43 clamping force is therefore variable and is directly proportional to the patient's weight. Thus, the appropriate amount of force is applied by and through retainer 43 and the patient's body weight.

Another novel feature of the invention is that foot retainer 43 will accommodate each and every ankle size from a small person to a large person; therefore foot retainer 43 and device 1 are universally sized for small and large patients. The limiting factor to the size of patient device 1 will accommodate is the length of base 45. Length of base 45 is limiting because the patient's ankles must fit within and/or in between top 49 and surface 3 for the self retaining functionality of foot retainer 43 to operate.

Figure 8:
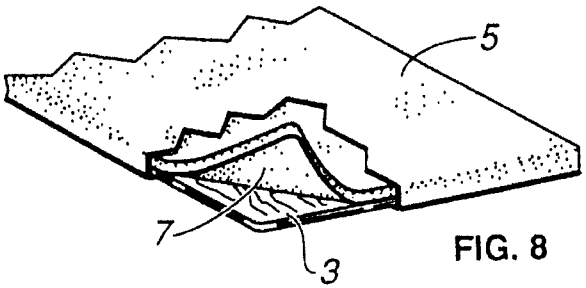

In the preferred embodiment, surface 3 is skinned by a material 5 such as vinyl, leather, or plastic having an extremely low coefficient of friction shown in FIG. 8. The low coefficient of friction is desirable to employ the patient's body weight both as the force to retain the patient in a head-down, pitched and/or tilted position and as the force of stretching the vertebrae of the neck, spine and/or other body parts which benefit from traction therapy. Low coefficient of friction is defined by a coefficient of friction whereby the patient would freely slide along and off the device to the floor if not retained on the board by retaining means. In addition, the preferred embodiment provides for a surface pad 7 between surface 3 and material 5 to accommodate comfort and prolonged stamina required and associated with traction therapy.

In the preferred embodiment, material 5 employed for skinning surface 3 is further coated with a topical lubricant such as ARMORALL® and or other lubricant agent which promotes a lasting reduction of friction between the vinyl skin and the patient. ARMORALL® is an effective and economical product which is readily and commercially available in department and auto supply outlets.

While the invention has been described with reference to a particular embodiment thereof, those skilled in the art will be able to make various modifications to the described embodiment of this invention without departing from the true spirit and scope thereof. It is intended that all combinations of elements and steps which perform substantially the same function in substantially the same way to achieve substantially the same results are within the scope of this invention.

What is claimed is:

1. A traction device comprising in combination:

a) an elongated flat surface defined by spaced-apart sides including a foot-end and a head-end arranged in a spaced-apart relationship;

b) means for elevating said foot-end above said head-end in a tilted fashion; and, c) a foot retainer pivotally attached about said foot-end for retaining the patient's feet therein;

d) wherein said elongated flat surface is coated with a lubricant that provides an extremely low coefficient of friction for allowing the patient's body to stretch and slide freely downward therealong under its own weight when pitched in a head-down position.

2. The device of claim 1 wherein said means includes at least one support member to support the patient for elevation of said foot-end above said head-end in a tilted fashion.

3. The device of claim 1 wherein said foot retainer includes a base and a top transversely attached thereto wherein said base is pivotally attached to said foot-end of said elongated flat surface and the patient's feet are placeable between said top and a terminal end of said pivotally attached base for automatically and self-adjustingly clamping the ankles of the patient as said top is pivotally pulled by the patient's feet to said surface and atop patient's ankles by the gravitational force exerted on the patient's body.

4. The device of claim 3 further including a pad surrounding said foot retainer wherein said pad comprises a soft material for facilitating comfort for the patient and an increased surface area of contact between the patient's ankle and foot and said pad.

5. The device of claim 1 wherein said elongated flat surface is padded for facilitating comfort for the patient during traction therapy.

6. The device of claim 1 wherein said elongated flat surface comprises:

a) a bottom section containing said foot end;

b) a top section containing said head end; and, c) hinge means interconnected said bottom section and said top section, along a hinge end on each said section, to allow said sections to be folded together for transport and unfolded into said elongated flat surface for use.

7. The device of claim 6 wherein said hinge means comprises at least one door hinge spanning along and attached to said hinge-ends of said top and said bottom sections.

8. The device of claim 6 wherein said hinge means comprises a piano hinge spanning along and attached to said hinge-ends of said top and said bottom sections.

9. The device of claim 6 further including a pad surrounding said foot retainer wherein said pad comprises a soft material for facilitating comfort for the patient and an increased surface area of contact between the patient's ankle and foot and said pad.

10. The device of claim 6 further including a hinge for pivotal attachment of said foot retainer to said foot-end.

11. The device of claim 6 wherein said means for elevation of said foot-end above said head-end includes:

a) a first U-shaped stand having two terminal ends axially and pivotally attached to said top section;

b) a second U-shaped stand having two terminal ends axially and pivotally attached to said bottom section;

c) a first pair of stop-stubs attached to said sides of said top section for abutment with said first U-shaped stand and for securing said first U-shaped stand in a ninety degree relationship to the ground plane;

d) a second pair of stop-stubs attached to said sides of said bottom section for abutment with said second U-shaped stand and for securing said second U-shaped stand in a ninety degree relationship to the ground plane;

e) said first and said second pairs of stop-stubs attached to said sides between said first and said second U-shaped stands for maintaining said U-shaped stands in an upright ninety degree relationship to the ground floor; and, f) a cable having a first terminal end attached to said first U-shaped stand and a second terminal end attached to said second U-shaped stand, said terminal ends defining a predetermined cable length to maintain said U-shaped stands in a ninety degree relationship to the ground plane.

12. The device of claim 11 wherein said first U-shaped stand terminal ends terminate in a curved arrangement and pivotally attach to said sides of said top section defining a space pocket to accommodate a human hand therein in the event of collapse of said device.

13. The device of claim 6 wherein said bottom section and said top section are folded for transport by pivotally rotating said top and said bottom sections along said hinge means for juxtaposed abutment with said sections along its respective back sides.

14. The device of claim 6 further including a lock means affixed to said foot-end and said head-end for retaining said surface in a transport position.

15. The device of claim 14 wherein said lock means includes a hook and loop attachment.

16. The device of claim 15 wherein said lock means includes a hoop and loop attachment.

17. The device of claim 6 further comprising a handle affixed about said device for carrying and transporting said device.

18. The device of claim 6 further including a self-sizing ankle mechanism wherein the maximum ankle size is determined by length of said base of said foot retainer.

19. The device of claim 6 wherein said elongated flat surface is padded for facilitating comfort for the patient during traction therapy.

20. A traction device comprising in combination:

a) an elongated flat surface defined by spaced-apart sides including a foot-end and a head-end arranged in a spaced-apart relationship;

b) means for elevating said foot-end above said head-end in a tilted fashion; and, c) a foot retainer pivotally attached about said foot-end for retaining the patient's feet therein;

d) wherein said elongated flat surface is coated with a lubricant that provides an extremely low coefficient of friction for allowing the patient's body to stretch and slide freely downward therealong under its own weight when pitched in a head-down position.

21. The device of claim 20 further including a pad surrounding said foot retainer wherein said pad comprises a soft material for facilitating comfort for the patient and an increased surface area of contact between the patient's ankle and foot and said pad.

22. The device of claim 20 further including a self-sizing ankle mechanism wherein the maximum ankle size is determined by length of said base of said foot retainer.

23. A traction device comprising, in combination:

a) an elongated flat surface defined by a foot end and a head end arranged in spaced-apart relationship;

b) at least one support member attached to said elongated flat surface to elevate said foot end above said head end in a tilted fashion; and, c) a foot retainer having a base and a top transversely attached thereto wherein said base is pivotally attached to said foot end of said elongated flat surface and the patients' feet are placeable between said top and a terminal end of said base for automatically and self-adjustingly clamping the ankles of the patient as said top is pivotally pulled by the patient's feet to said elongated flat surface and atop the patient's ankles by the gravitational force exerted on the patient's body; and, d) wherein said elongated flat surface is coated with a lubricant that provides an extremely low coefficient of friction for allowing the patient's body to stretch freely downward therealong under its own weight when pitched in a head-down position.

* * * * *